United States Patent [19]

Jackson

[11] Patent Number: 4,934,112

[45] Date of Patent: Jun. 19, 1990

[54] MULTIPLE HEAD ABRASIVE CUTTING OF GLASS

[75] Inventor: Christopher J. Jackson, Toledo, Ohio

[73] Assignee: Libbey-Owens-Ford Co., Toledo, Ohio

[21] Appl. No.: 330,170

[22] Filed: Mar. 29, 1989

[51] Int. Cl.[5] ..... B24C 3/00; B24B 7/07; B26D 3/00

[52] U.S. Cl. ..... 51/410; 51/235; 51/240 GB; 83/53; 83/177

[58] Field of Search ..... 51/235, 238 S, 240 GB, 51/319, 320, 321, 283 R, 410, 417, 418; 83/53, 177, 451

[56] References Cited

U.S. PATENT DOCUMENTS

| | | | |
|---|---|---|---|
| 3,859,878 | 1/1975 | Bonaddio et al. | 83/425.4 X |
| 4,278,193 | 1/1981 | Pereman et al. | 225/2 |
| 4,362,461 | 12/1982 | Cathers | 414/752 |
| 4,406,091 | 9/1983 | Eckardt | 51/283 E X |
| 4,433,835 | 2/1984 | Wheeler | 269/21 X |
| 4,656,791 | 4/1987 | Herrington | 51/410 |
| 4,703,591 | 11/1987 | Herrington | 51/410 X |

FOREIGN PATENT DOCUMENTS

| | | | |
|---|---|---|---|
| 0696398 | 8/1953 | United Kingdom | 83/53 |

*Primary Examiner*—Frederick R. Schmidt
*Assistant Examiner*—Bruce P. Watson
*Attorney, Agent, or Firm*—Marshall & Melhorn

[57] ABSTRACT

The invention pertains to cutting irregularly shaped glass parts from glass blanks, and providing interior openings or cutouts in the parts, at a relatively high volume. Glass blanks are conveyed one-by-one to a transfer position beneath a shuttle carrier. The shuttle carrier picks up each sheet by means of vacuum cups and transfers it to the table of a cutting machine. A plurality of ganged abrasive jet cutting heads follows a prescribed path to cut a corresponding plurality of parts from the blank. The cutting heads then trace a second prescribed path to provide an interior cutout in each part. The ganged cutting heads may make additional passes to cut additional nested sets of parts from the blank. Upon completion of cutting, a second shuttle conveyor moves into position over the cutting table and, by means of vacuum cups thereon, picks up the individual parts and cutout portions and transfers them to a run-out conveyor for subsequent fabricating steps. The cutting machine table tilts upwardly to deposit the remaining selvedge from the blank in an adjacent cullet receptacle.

16 Claims, 6 Drawing Sheets

MULTIPLE HEAD ABRASIVE CUTTING OF GLASS

BACKGROUND OF THE INVENTION

1. Field of the Invention

The present invention pertains generally to the cutting of glass patterns from a blank sheet of glass, and more particularly to simultaneously cutting a plurality of such patterns from the blank sheet by means of abrasive fluid jets and separating the pattern cuts from the resulting selvedge material.

2. Description of the Prior Art

There is a trend in automotive vehicle styling to employ glazing units having irregular outlines and/or interior cut out areas or openings for various purposes. One such glazing unit particularly in demand comprises a generally triangular light having a similarly shaped triangular opening in one of its corner regions. The units may have rounded corners. Formation of such units and removal of the interior portion by conventional glass cutting techniques is difficult, time consuming and expensive. Thus, automotive glass is normally cut to the prescribed pattern by scoring one surface, and then flexing the glass along the score line to break out the pattern. This technique is not entirely satisfactory for severing glass along curved lines or for removing interior portions from a glass sheet.

The use of high pressure abrasive fluid jets has been proposed for cutting intricate patterns from glass and for producing interior cut outs within glass blanks. U.S. Pat. Nos. 4,656,791 and 4,703,591 pertain to such abrasive jet cutting of glass and are concerned, respectively, with support mechanism for the glass blank during cutting and for increasing the cutting speed while maintaining the quality of the cut edge. While the disclosed inventions represent a significant advance in the art of cutting patterns from glass they have certain limitations due to the time required for producing each pattern cut unit. They may thus not be able to produce the units in the volume desired for an automotive glass fabrication line.

U.S. Pat. No. 3,859,878 to Bonaddio et al. suggests the use of ganged scoring tools in order to simultaneously subdivide a glass sheet into a plurality of small pieces using conventional scoring and flexing techniques. While the device increases the rate at which large sheets may be subdivided along generally straight lines, it is not adapted to cutting intricate patterns or to making interior cutouts in the sheets. U.S. Pat. No. 4,278,193 to Perelman et al. likewise is concerned with conventional scoring and breaking techniques. First and second score lines are applied to a glass sheet so as to define two nested glass blanks to be subsequently broken out from the glass. The glass is split between the blanks into two parts. The parts are then separated and the blanks are broken out from each part.

U.S. Pat. No. 4,362,461 to Cathers pertains to a system for scoring, snapping, separating and stacking sheets employing a vacuum device for lifting or picking up selected ones of sheet articles as from a conveyor and laterally transferring and depositing them in another area. The wall of the vacuum chamber facing the sheet articles has an apertured plate covered by a foraminous pad which defines the sheet engaging surface. An isolating device provided within the vacuum chamber moves between a first position where it isolates the chamber from the vacuum source and a second position where it provides communication with the source for supplying vacuum to appropriate areas of the plate and pad for picking up the selected one of the sheets.

U.S. Pat. No. 4,467,168 to Morgan et al. discloses use of a laser for cutting glass to intricate shapes. The glass is suitably supported along either side of the proposed line of cut. A laser beam directed onto the glass vaporizes a first thickness of the glass, and a jet of gas directed to the laser focal point removes the vaporized glass and penetrates the glass. The laser and glass are moved relative to one another to sever the glass along the desired path.

SUMMARY OF THE INVENTION

There remains a need for a system of cutting irregularly shaped glass parts from blanks, and providing interior openings in the parts, at a relatively high volume on a production line basis. To that end, in accordance with the present invention a plurality of individual parts is simultaneously cut from a single glass blank to any desired configuration. Interior openings or cut outs may also be formed in the parts. Glass blanks are deposited on a conveyor and advanced one by one by the conveyor to a transfer position beneath a shuttle carrier. Vacuum cups on the shuttle carrier pick up the blank and the shuttle transfers it to the table of a cutting machine. The blank is supported on the table along either side of the lines along which the cuts are to be made. A bank of abrasive cutting heads is moved in unison so as to cut a first set of parts from the blank. The heads may then be moved along a second path to cut a second nested set of parts from the blank. The heads may then be moved along third and fourth paths to form interior cutouts in the first and second sets of parts, respectively.

Following cutting, a second shuttle conveyor advances over the cutting table and vacuum cups thereon attach to and pick up the individual parts and the interior pieces cut therefrom. The shuttle conveyor transfers the parts and pieces to a first endless belt or runout conveyor. The individual parts are carried by the first conveyor, across a gap and onto a second conveyor, for subsequent fabricating steps such as washing and/or heat treating. The interior cut out pieces, due to their smaller size, drop through the gap into a cullet box beneath the conveyors. The table of the cutting machine includes a tilt bed independent from the supports for the cut out parts and interior pieces. Following transfer of the parts and pieces by the shuttle conveyor, the tilt bed flips upwardly and deposits the selvedge from the blank into an adjacent cullet bin. A catcher tank is provided beneath the cutting table for receiving debris from the abrasive jet cutting heads.

BRIEF DESCRIPTION OF THE DRAWINGS

In the drawings, wherein like numerals refer to like parts throughout.

DETAILED DESCRIPTION OF THE PREFERRED EMBODIMENT

Figure 1:
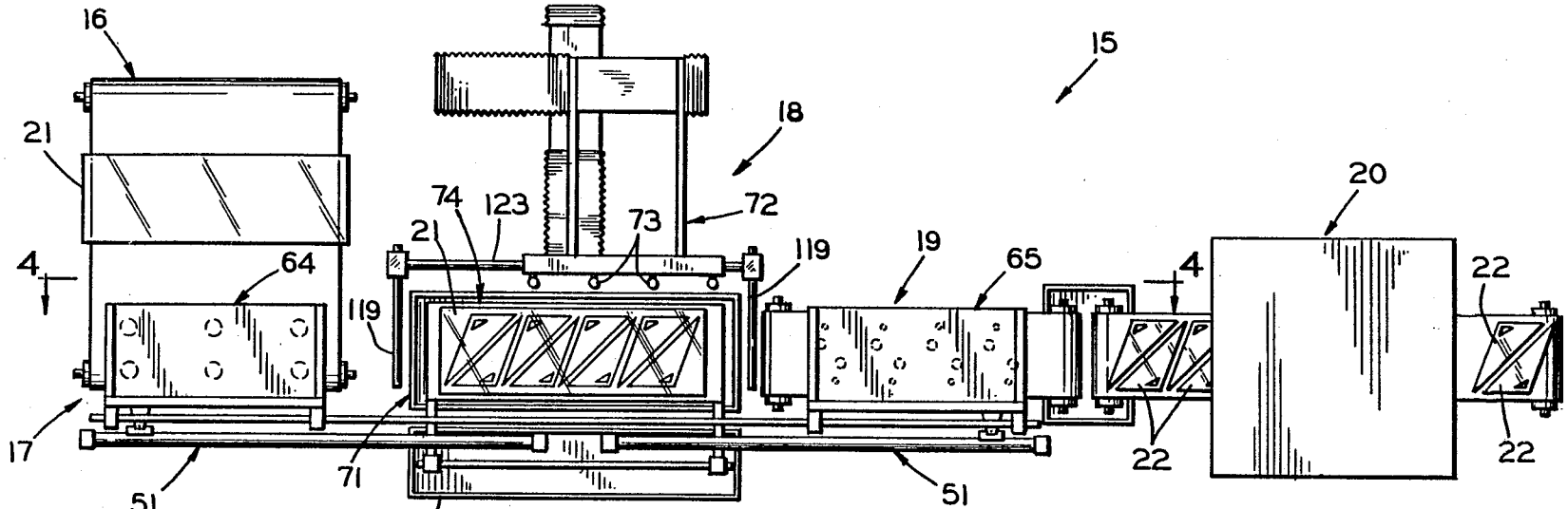
FIG. 1 is a schematic plan view of apparatus embodying the invention.
Figure 2:
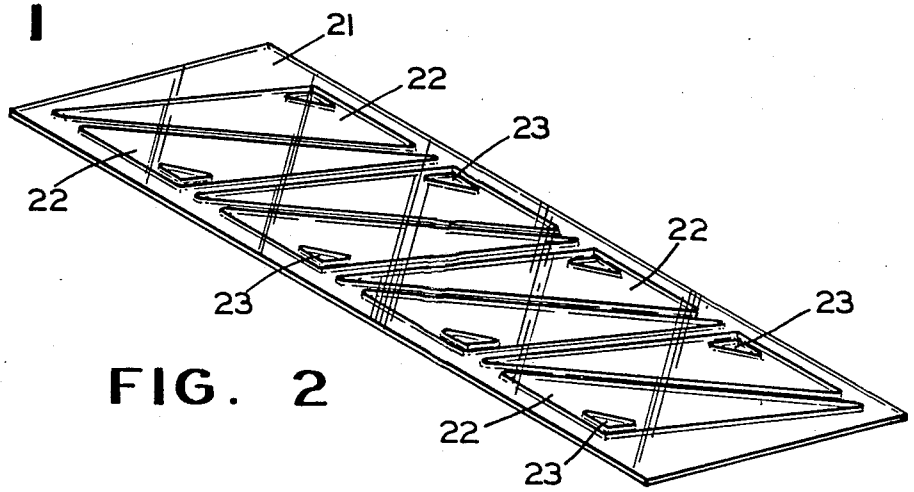
FIG. 2 is a perspective view of a glass blank illustrating individual nested parts as cut therefrom by the invention.
Figure 3:
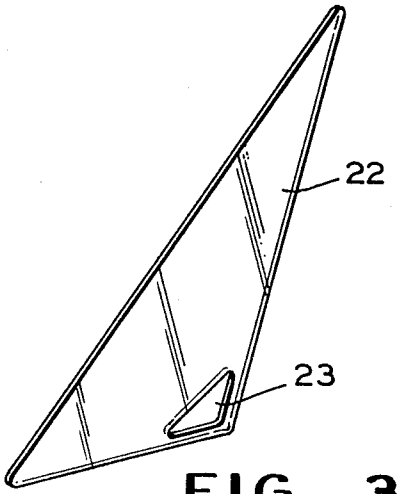
FIG. 3 is a perspective view of an individual part cut from a glass blank in accordance with the invention.

With reference now to the drawings, and in particular to FIG. 1, there is shown generally at 15 a multiple head abrasive cutting system constructed in accordance with the invention. The cutting system includes a glass blank receiving conveyor section 16, a shuttle loading section 17, a cutting station 18, a shuttle transfer section 19, and a processing station 20, arranged sequentially. As will be hereinafter described, the cutting system is adapted to receive a glass blank 21 and provide a series of cuts through the blank as shown in FIG. 2 to form a plurality of individual glass parts 22 having cut out portions 23 as shown in FIG. 3.

Figure 4:
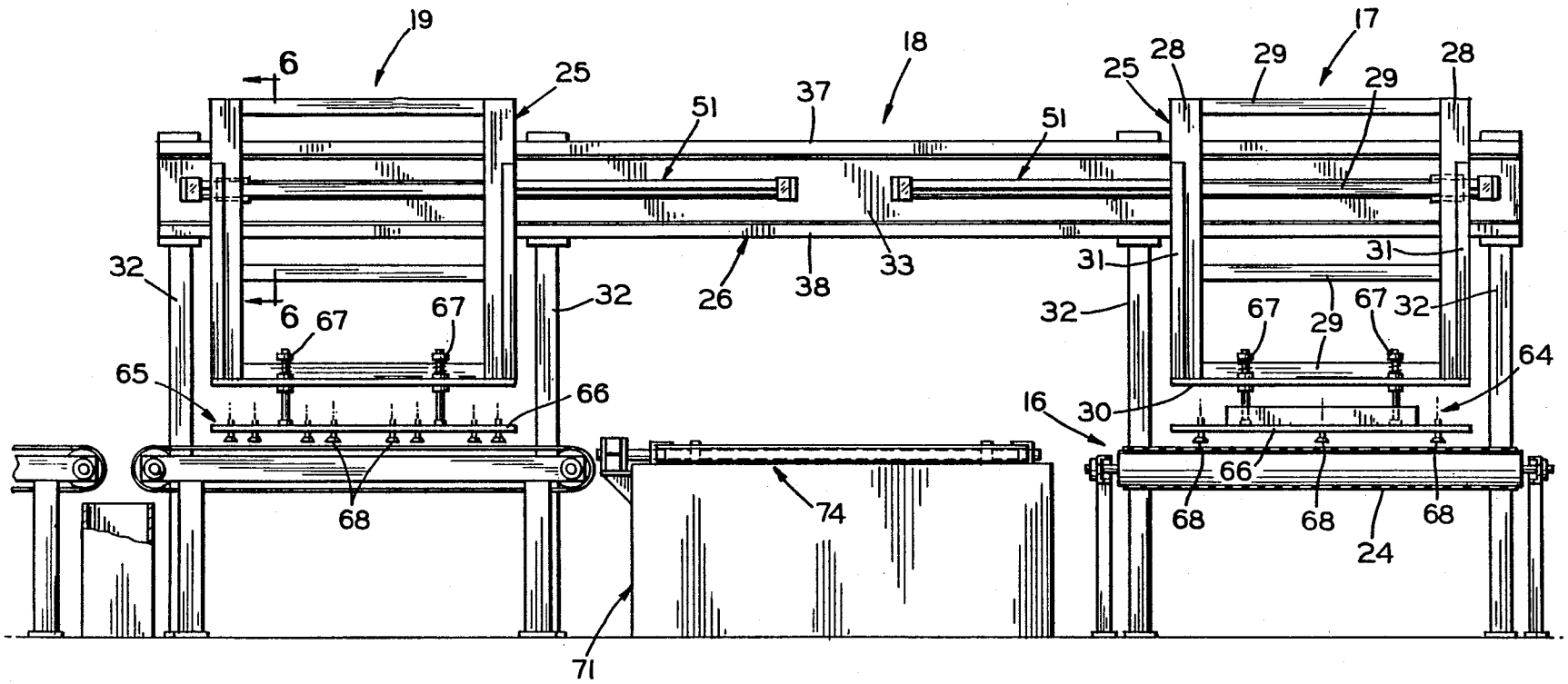
FIG. 4 is a side elevational view taken substantially along line 4—4 of FIG. 1.

The receiving conveyor section 16 more particularly comprises an endless belt or apron 24 mounted and driven in a conventional manner to carry the glass blanks 21 one after another into position beneath the shuttle loading section 17. As best shown in FIG. 4, the shuttle loading section 17 and the shuttle transfer section 19 are generally identical in construction, except for the arrangement of their vacuum pickup members, and thus the two sections will be described together. Each shuttle includes a carriage framework, identified generally at 25, mounted for reciprocating to-and-fro movement upon a beam assembly 26 extending between the shuttle loading and transfer sections. The framework comprises upstanding frame members 27, having facing plates 28, interconnected by cross braces 29 and carrying at their lower end a base plate 30. The base plate is further affixed to the end members by diagonal struts 31.

Figure 6:
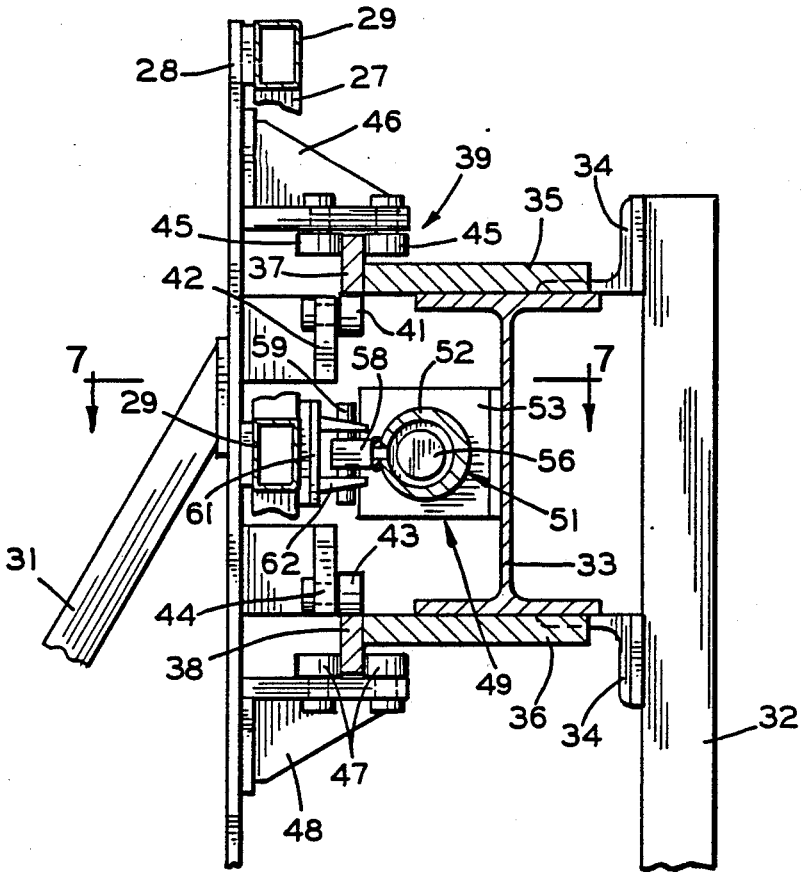
FIG. 6 is an enlarged, fragmentary side view taken substantially along line 6—6 of FIG. 4.

As will best be seen in FIGS. 4 and 6, the beam assembly 26, carried upon a series of support posts 32, includes a wide flange beam 33 affixed to the posts by angle brackets 34. Upper and lower L-shaped track members 35 and 36, respectively, are affixed to the flanges of the beam 33. The track members have upwardly and downwardly depending legs 37 and 38, respectively, along which the carriages 25 are carried by means of a roller system shown generally at 39 (FIG. 6). The roller system more particularly comprises an upper roller 41 affixed to a bracket 42 carried by the framework 25 and adapted to roll along the bottom edge of the leg 35. A similar roller 43 affixed to a bracket 44 on the framework 25 is adapted to roll along the top edge of the leg 38. Upper guide rollers 45 carried by a bracket 46 affixed to the framework are adapted to roll along either side surface of the leg 37, and similar lower guide rollers 47 carried by a bracket 48 affixed to the framework are adapted to roll along either side surface of the leg 38. The carriage framework 25 is thus supported upon and free to move along the beam assembly 26 in a path defined by the track members 35 and 36.

Figure 7:
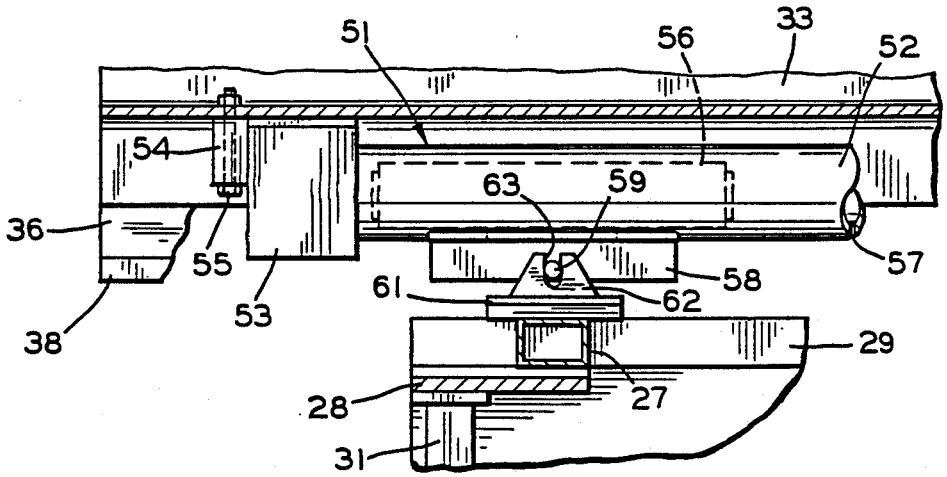
FIG. 7 is a fragmentary plan view taken substantially along line 7—7 of FIG. 6.

Controlled movement of the carriage framework along the track assembly is provided by a linear drive system, identified generally at 49. The drive system preferably utilizes so-called rodless cylinders such as those available from the Origa Corporation of Elmhurst, Ill. as the drive means. More particularly, there is affixed to the web of the beam 33 for each of the carriages 25 a rodless cylinder 51 of such length as to reciprocably move the carriage between the extremities of its operating path. As will be apparent in FIGS. 6 and 7, the cylinders conventionally include an elongated tubular member 52 having fittings 53 at each end for connecting the cylinders to sources of compressed air (not shown). The end fittings may also include bosses 54 for mounting the cylinders on the beam 33 as by bolts 55.

A piston 56 within the tubular member 52 is adapted to move back and forth therein in response to air admitted and withdrawn through the end fittings in a controlled manner. The piston is connected, through an elongated slit 57 in the wall of the tubular member and having an appropriate seal, to an external lug 58 adapted to travel along the tubular member with the piston. A coupling pin 59 is carried by the lug so as to project above and below the lug. A yoke 61 affixed to the carriage framework 25 includes bifurcated arms 62 defining open-ended slots 63 for receiving the coupling pin to couple the carriage framework to the piston. Thus, as will be readily apparent the carriages of the shuttle loading section 17 and transfer section 19 may be moved along the beam assembly to selected positions by means of the linear drive system 49.

The base plate 30 of the carriage framework 25 of the loading and transfer sections 17 and 19 carries vacuum transfer devices 64 and 65, respectively. The devices 64 and 65 are generally similar and of a construction standard in the flat glass industry, the difference being primarily in the location of the vacuum heads, which is dictated by the configuration and location of the glass pieces to be transferred. Inasmuch as the devices are of standard construction, the details of which are not part of the invention, they have been illustrated schematically in Figs. 1 and 4. Thus, as shown therein, each of the transfer devices 64 and 65 includes a support plate 66 suspended from the base plate 30 as by spring-loaded plungers 67. The plungers are adapted to permit the support plate to be depressed as by a short stroke cylinder (not shown) so that vacuum heads 68 carried thereby engage the upper surface of a glass part on the conveyor or cutting table therebeneath. Vacuum is applied to the vacuum heads, and the short stroke cylinder is deactivated so that the support plate is retracted by the plungers 67 to pick up the glass part for lateral movement.

Figure 5:
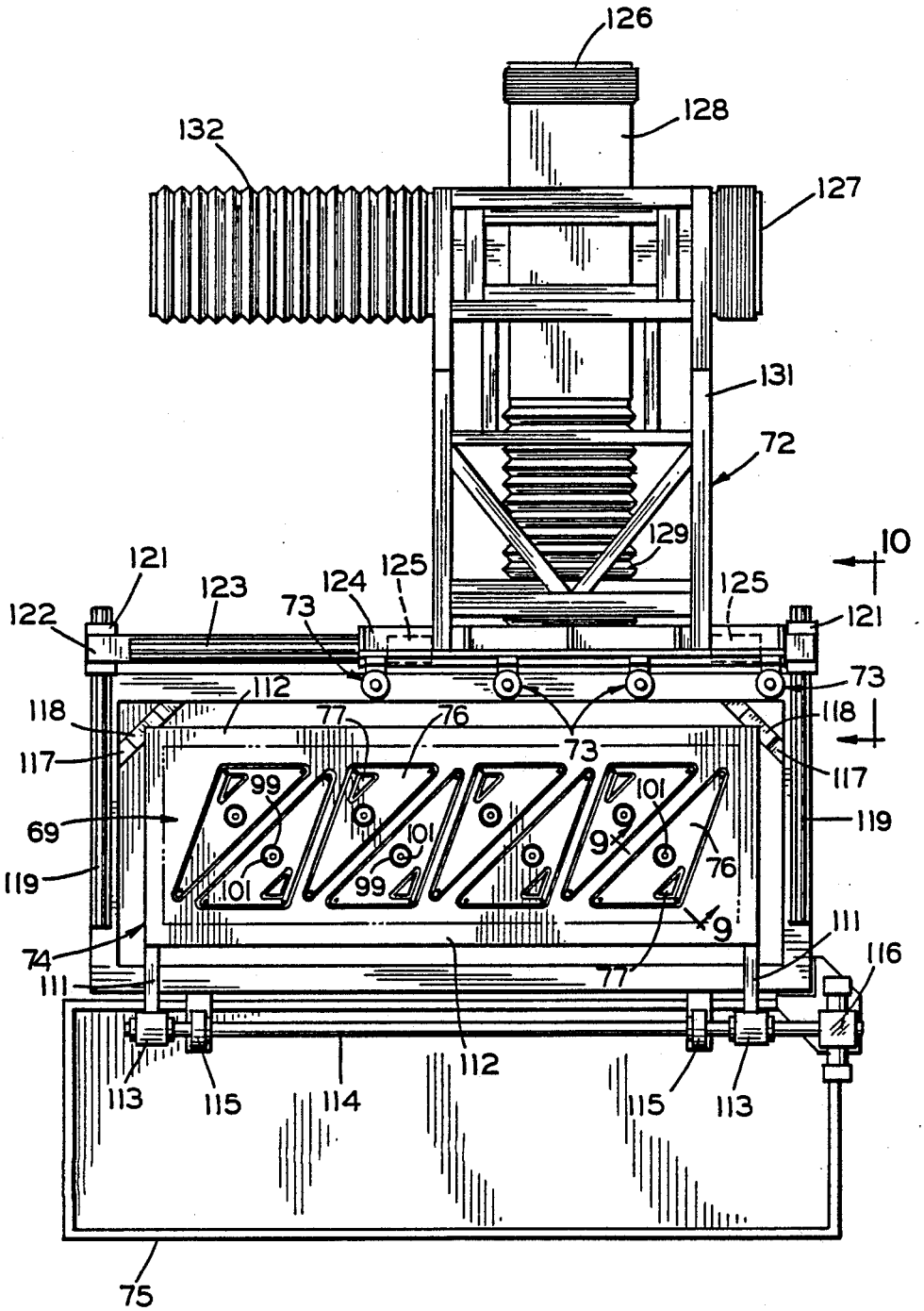
FIG. 5 is an enlarged plan view of the cutting station of the invention.

As best seen in FIG. 5, the cutting station is adapted to receive a glass blank 21, cut a plurality of individual glass parts 22 therefrom, and cut out portions 23 from the parts 22. After the parts 22 and cut out portions 23 are removed by the transfer section 19, the remaining selvedge material is dumped into an adjacent cullet bin. To that end the cutting station comprises a cutting bed, shown generally at 69, disposed above a catcher tank 71. An x-y cutting mechanism 72 carries a plurality of abrasive cutting heads 73 disposed to traverse the cutting bed according to a prescribed pattern. The cutting bed includes a flipper section 74 adapted to pivot upwardly and dump the selvedge glass into an adjacent cullet box 75.

As described in the aforementioned U.S. Pat. No. 4,656,791, in abrasive fluid jet cutting of glass, it is important that the glass be uniformly supported over its entire area and on both sides of the line or lines of cut. The cutting bed 69 and the flipper section 74 are, of course, disposed over the catcher tank 71 so that it receives the debris from the cutting process. In order to get the maximum yield from the glass blank 21, that is, to minimize the amount of glass which must be discarded, and for economy of cutting, every effort is made to arrange for the parts to be cut from the blank in nested fashion. Thus, as will be apparent in FIG. 5 the generally triangular ventilator lights 22 are cut from the blank 21 in an alternate, oppositely disposed arrangement so as to utilize as nearly as possible a common side for adjacent lights. The abrasive jet stream will, of course, not only cut through the class sheet but also will penetrate any supporting member in its path directly behind the glass. The supporting member upon which the glass is cut may thus utilize a sacrificial support plate which is changed after each blank is cut or, preferably as in the invention, a support system which defines spaces or gaps along the lines of cutting and which uniformly supports the glass on both sides of the cuts.

Figure 8:
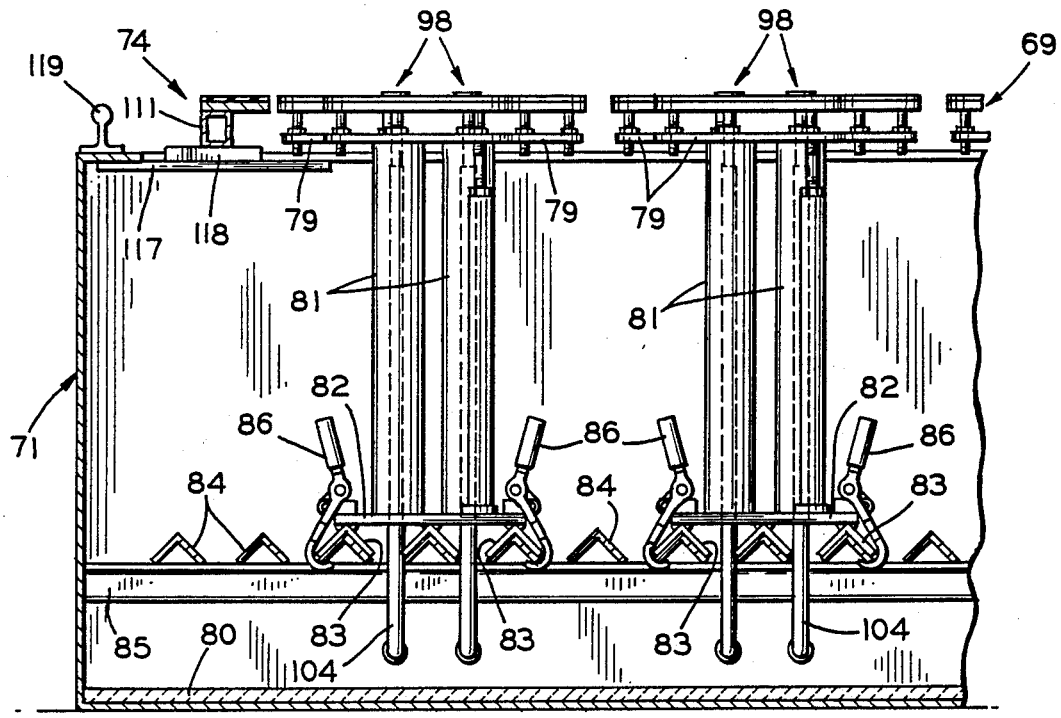
FIG. 8 is a longitudinal, vertical section through a portion of the cutting table and catcher tank of the invention.
Figure 9:
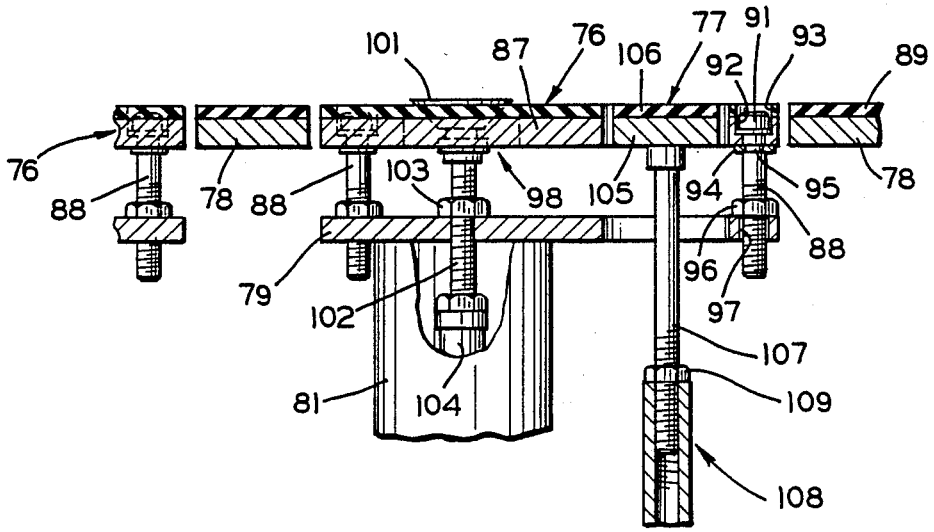
FIG. 9 is an enlarged sectional view taken substantially along line 9—9 of FIG. 5.

In accordance with the invention, as best seen in Figs. 5, 8 and 9, the cutting bed 69 comprises a series of support modules 76 and 77, one for each glass part 22 and each cut-out portion 23, respectively, encompassed within a bed plate 78 defining the supporting surface of the flipper section 74. The modules 76 and 77 are supported from the bottom of the catcher tank 71 independently from the bed plate 78 to provide an unobstructed passage for the abrasive fluid jet completely around the modules. To that end each module 76 comprises a support plate 79 affixed atop a tubular support column 81. The two columns of each associated pair of modules are affixed at their lower ends to a base plate 82. The base plate has affixed to its lower surface as by welding a plurality of spaced inverted angle members 83 which are adapted to nestably rest upon similar transversely extending inverted angle members 84 supported at their ends upon longitudinal supports 85 in the bottom area of the catcher tank. The base plate is releasably secured to the angle members 84 as by over-center type clamps 86. The angle members 84 serve to deflect and diffuse the abrasive jet streams before they impinge upon a resilient liner 80 provided on the bottom of the catcher tank.

As hereinbefore indicated, it is extremely important that the glass supporting surface be in alignment on opposite sides of the lines of cut. Accordingly, the cutting bed 69 of the module 76 comprises a plate member 87 affixed to the support plate 79 as by threaded adjusting posts 88. As best shown in FIG. 9, the actual glass contacting surface of the cutting bed comprises a layer 89 of a durable resilient material, such as neoprene, bonded to the surface of the plates forming the cutting bed. The adjusting posts extend through and are free to rotate within the plate member, and include heads 91 provided with recesses (not shown) as of the type for receiving an allen wrench and disposed within a counterbore 92 in the plate member and an aligned opening 93 in the resilient layer 89. A snap ring 94 received within a groove 95 in the post beneath the plate member rotatably captures the post within the plate member. The distal end of the post is threaded into a nut 96 affixed to the support plate 79 in axial alignment with an unthreaded opening 97 in the plate. It will thus be readily apparent that by rotatably manipulating the adjusting posts 88 at the apexes of the module 76, its supporting surface may be properly aligned with that of the adjacent support members.

In order to secure the glass blank and in particular the individual parts 22, against movement during the cutting operation, there is provided within each of the modules 76 a vacuum hold down device 98. The vacuum devices engage the overlying glass and urge it against the supporting surface of the resilient layer 89. The plate member 87 and overlying layer 89 of each of the modules 76 are provided with a centrally located opening 99 within which a vacuum cup 101 is positioned. The vacuum cup is positioned directly over the tubular support column 81 and is carried atop a post 102 threaded through a nut 103 affixed to the support plate 79. The elevation of the vacuum cup can thus be set by turning the post within the nut to position its resilient lip slightly above the surrounding supporting surface to insure that the vacuum cup will sealingly engage the surface of a sheet deposited thereon. The post 102 includes an interior longitudinal passageway (not shown) and is connected at its lower end to a tubular conduit 104 extending downwardly within the column 81 and out through the wall of the catcher tank 71 for connection to a vacuum source (not shown). The vacuum cup, in turn, is coupled to the vacuum source so that a vacuum may be selectively applied thereto as required during the cutting operation.

The module 77 for supporting the cut-out portion 23 includes a plate member segment 105 and a resilient layer segment 106 separate and spaced from the corresponding members 87 and 89, respectively, of the module 76. A post 107 affixed to the segment 105 is threaded at its distal and into a tubular column 108 carried by the base plate 82. A jam nut 109 is provided on the post atop the tubular column for securing the module 77 in a selected vertical and angular position.

The flipper section 74 comprises a spaced pair of side arms 111 interconnected by longitudinal beam members 112 to form a rectangular framework for carrying the bed plate 78 which encompasses the modules 76. With the flipper section retracted, the bed plate represents a continuation of the plate member 87, and its top surface is likewise covered with the resilient layer 89. The side arms are carried at their rear ends in blocks 113 keyed to a shaft 114 journalled in pillow blocks 115 suitably mounted as on the catcher tank.

A rotary actuator 116, as of a commercially available hydraulic type, is drivingly connected to the shaft 11 for rotating it upon command to swing the flipper section 74 through a prescribed arc between its normally at rest position as shown in the drawings, and a raised position (not shown) for depositing selvedge or scrap glass into the cullet box 75. It may, for example, swing through an arc of 120° to insure that all debris from the previous cutting cycle is removed from the surface. In order to support the free end of the flipper section and insure that it return to a precise position upon retraction, braces 117 having bearing plates 118 thereon are provided across the corners of the catcher tank. As shown in FIGS. 5 and 8, the ends of the side arms 111 rest upon the bearing plates with the flipper section in the at-rest position.

The basic x=y system 72 upon which the abrasive jet cutting heads 73 are mounted is of a commercially available type which is, per se, well-known to those skilled in the art. Thus, it will be described herein to the extent deemed necessary for incorporation into the invention. The x=y system functions to simultaneously move the cutting heads 73 along perpendicular axes in a coordinated manner so that the cuttings heads follow prescribed paths defining the parts 22 and the cut out portions 23.

Figure 10:
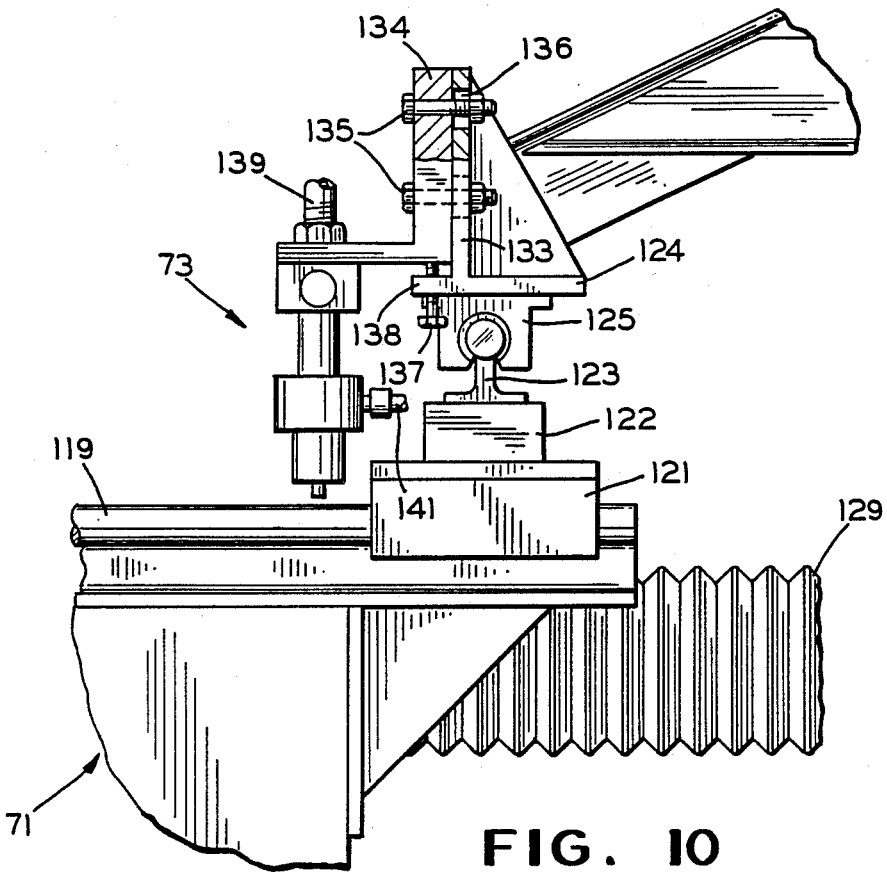
FIG. 10 is an enlarged fragmentary elevational view, partially in section, taken substantially along line 10—10 of FIG. 5.

More particularly, there is mounted atop each end of the catcher tank a transverse slide rail 119 having a slide block 121 adapted for movement therealong. The slide members are interconnected by a beam 122 upon which is mounted a longitudinal slide rail 123. A carriage bar 124 is affixed to slide blocks 125 mounted for sliding movement along the rail 123. As best shown in FIGS. 5 and 10, the abrasive cutting heads 73 are affixed in appropriately spaced relation along the carriage bar. Thus, as will be readily apparent, the ganged cutting heads 73 may be moved along any desired path by imparting appropriate movement to the carriage bar along the slide rails 119 and 123.

The slide rails, in effect, comprise x and y axes, and such controlled movement therealong is provided by the system 72. More particularly, the system includes perpendicularly disposed transverse and lateral actuators 126 and 127, respectively, controlled as by a computer (not shown) programmed to correlate their operation whereby the cutting heads 73 follow prescribed paths over the glass blank 21. The transverse actuator is mounted upon a base (not shown) alongside the apparatus and appropriately connected at its forward end to the structure of the catcher tank. The transverse actuator includes a housing 128 and associated expandable bellows 129 within which is contained mechanism for linearly advancing and retracting the housing. The lateral actuator 127 is mounted upon the housing 128 so as to move therewith as the housing is advanced and retracted. A framework 131 carried by the lateral actuator is affixed to the carriage bar 124. Mechanism disposed within an expandable bellows 132 of the lateral actuator imparts translatory motion to the framework 131, thereby moving the carriage bar 124 and the slide blocks 125 along the longitudinal slide rail 123. Advancement and retraction of the housing 128 will likewise advance and retract the framework 131 and move the carriage bar and associated beam 122 and slide blocks 121 along the transverse slide rails 119.

As shown in FIG. 10, the carriage bar includes an upstanding flange 133 upon which the abrasive cutting heads are mounted as by angle brackets 134. The number and spacing of the cutting heads along the carriage bar will be determined by the particular glass parts 22 to be cut from the blank. The brackets are affixed by bolts 135 extending through vertical slots 136 in the upstanding flange. An adjusting screw 137 threaded through an extension 138 on the carriage bar engages the base of the angle bracket for providing vertical adjustment of the cutting head relative to the cutting bed 69. The angle bracket 134 includes a leg to which the cutting heads 73 are affixed. The cutting heads may, for example, be of a construction similar to those disclosed in the aforedescribed U.S. Patents, Nos. 4,656,794 and 4,703,591, and are suitably provided with conduits 139 for supplying fluid under high pressure and lines 141 for providing abrasive particles to be aspirated into the fluid streams in the usual manner.

Figure 11:
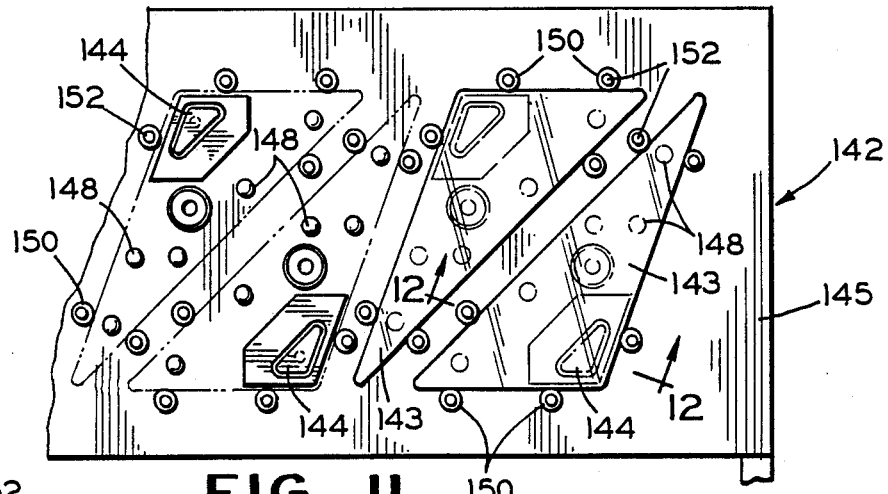
FIG. 11 is a fragmentary plan view of an alternate embodiment of the cutting table.
Figure 12:
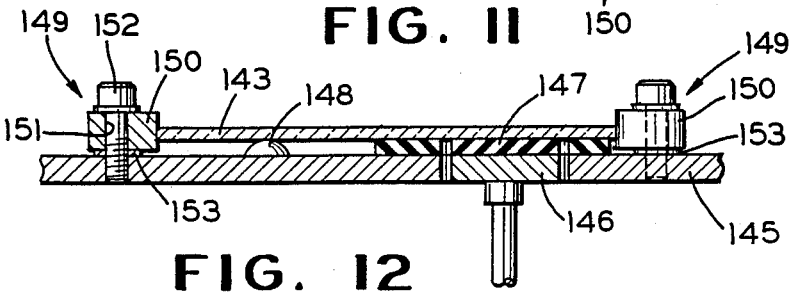
FIG. 12 is an enlarged, fragmentary sectional view taken substantially along line 12—12 of FIG. 11.

In some instances it may be possible, or desirable, to cut the parts from the blank by conventional cutting methods as, for example, where the parts are relatively large and have straight edges. There is shown in FIGS. 11 and 12 an alternate embodiment of the invention adapted for cutting interior openings in such individual glass parts which have been previously cut to shape. Thus, there is provided in place of the cutting bed 69 a table 142 upon which individual glass parts 143 may be loaded, either manually or by means of a suitable mechanical loader (not shown) such as a robot or the shuttle transfer section 19. A segment 144 is to be cut from each part. The table includes a bed plate 145 and a support module 146 for each segment 144 to be cut from the part. The module and the surrounding area of the bed plate are covered by a layer 147 of resilient material. Support bumpers 148 are provided at spaced locations on the bed plate beneath the part for supporting the part in alignment with the surface of the resilient layer. Positioning guides 149 are provided on the bed plate for engaging the edges of the individual glass parts to assure that they are properly located relative to the support modules. The positioning guides more particularly include spools 150, having eccentrically located bores 151, secured to the bed plate by studs 152. Friction washers 153 are positioned between the spool and bed plate. Thus, the eccentric spools can be rotated to properly position the part 143, and then secured in this position by drawing down the studs 149. In loading the glass ports on the table 142, they are deposited within the outline defined by the support bumpers and thus will be properly oriented on the cutting table.

Reviewing briefly operation of the invention, glass blanks 21 are deposited one after another on the belt 24 of the receiving conveyor 16 and carried forwardly in sequence to the shuttle loading section 17. Each blank is picked up by the vacuum transfer device 64 and transferred by the shuttle to the cutting bed 69 of the cutting station 18. The blank is deposited on the bed and a vacuum is applied to the cups 101 to firmly secure the glass blank, and particularly the individual glass parts 22, to the bed. Thereafter the abrasive cutting system is cycled to cut first one set of the glass parts 22 and then the other set. Likewise, the portions 23 of first one set of parts 22 is cut out and then portions 23 are cut from the other set. Of course, the sequence in which the cutting steps are performed may be varied as desired.

Upon completion of the abrasive cutting, the vacuum heads 68 of the vacuum transfer device 65 pick up the individual parts 22 and cut out portions 23, and transfer them to the conveyor belt of the transfer section 19. The transfer section conveyor advances then to an adjacent belt conveyor of the associated processing station 20. The transfer section and processing station conveyors are slightly spaced from one another to provide a gap therebetween. While the parts 22 are of such size as to cross the gap, the cut-out portions 23, due to their small size, drop through the gap into a cullet bin therebelow. Alternatively, it is contemplated that in those situations where the cut-out portions 23 may be long enough to pass over the gap without dropping into the cullet bin, the parts 22 may be transferred to the belt of the transfer section 19 by the transfer device 65, and then advanced to the processing station while the cut-out portions remain on the support modules. The cut-out portions may then be transferred by the device 65 to the transfer section 19, and the belt thereof run in the reverse direction to deposit the cut out portions through a larger gap at the forward end of the conveyor into a cullet box (not shown) therebeneath. A flip-down conveyor belt section (also not shown) may also be provided at the gap between the conveyor belts of the transfer section and processing station. After the parts 22 and cut-out portions 23 are removed, the rotary actuator 116 is operated to pivot the flipper section 74 upwardly and deposit the selvedge material from the blank 21 into the cullet box 75. The system is then ready to repeat the cycle.

The various segments of the apparatus are provided with conventional controls well known and as will be readily apparent to those of ordinary skill in the art.

It is to be understood that the forms of this invention herewith shown and described are to be taken as illustrative embodiments only of the same, and that various changes in the shape, size and arrangement of the parts, as well as various procedural changes, may be resorted to without departing from the spirit of the invention.

What is claimed is:

1. Apparatus for cutting a plurality of individual parts of identical configuration from a glass blank comprising, a cutting station including a cutting bed for supporting a glass blank from which the parts are to be cut, said cutting bed comprises an individual support module for each said part, said support modules having an outline corresponding to the outline of said parts, said modules being supported independently from the remainder of said cutting bed and including means for aligning the supporting surfaces of said modules with the adjacent supporting surface of said cutting bed, a plurality of ganged abrasive fluid jet cutting heads mounted for controlled movement in unison over said cutting bed, means moving said ganged cutting heads along predetermined paths to simultaneously cut said plurality of individual parts from said blank, means lifting the severed individual parts and advancing said parts from said cutting bed, and means tilting said cutting bed to remove the selvedge portion of said blank following said lifting and advancing of said individual parts.

2. Apparatus for cutting a plurality of individual parts of identical configuration as claimed in claim 1, including a shuttle loading section for advancing a glass blank into said cutting station and depositing said blank on said cutting bed.

3. Apparatus for cutting a plurality of individual parts of identical configuration as claimed in claim 2, wherein said shuttle loading section includes a carriage framework mounted for reciprocating movement between a glass blank pickup position and said cutting station whereat said blank is deposited on said cutting bed, means for reciprocably moving said carriage framework between said blank pickup and depositing positions, and at least one vacuum cup on said carriage operable to selectively engage a said glass blank.

4. Apparatus for cutting a plurality of individual parts of identical configuration as claimed in claim 1, wherein said supporting surface of said cutting bed is spaced from said supporting surface of said modules to define a gap surrounding each said module, and including vacuum means in each said module for selectively holding said parts immobile against said supporting surface.

5. Apparatus for cutting a plurality of individual parts of identical configuration as claimed in claim 1, including a second support module within each said module for said parts, and means supporting each said second module independently from its associated support module and from the remainder of said cutting bed, said second module having a peripheral outline corresponding to a desired cut out area in said part.

6. Apparatus for cutting a plurality of individual parts of identical configuration as claimed in claim 5, wherein said supporting surface of each said module is spaced from the supporting surface of said second module to define a gap surrounding said second module to be followed by said ganged cutting heads in severing said cut outs from said parts.

7. Apparatus for cutting a plurality of individual parts of identical configuration as claimed in claim 1, including a catcher tank beneath said cutting bed, wherein said means supporting each said module includes a support column extending from the base of said catcher tank, a support plate on said column, and a plurality of adjusting posts adjustably connecting said module to said support plate.

8. Apparatus for cutting a plurality of individual parts of identical configuration as claimed in claim 7, wherein said support column is tubular, including an opening in the supporting surface of each said module above said tubular support column, vacuum means disposed in said opening and carried by said support plate for engaging the undersurface of said part, and means within said tubular column connecting said vacuum means to a source of vacuum for selectively holding said part immobile against the supporting surface of said module.

9. Apparatus for cutting a plurality of individual parts of identical configuration as claimed in claim 8, including a second support module within each said module for said parts, and means supporting each said second module independently from its associated support module and from the remainder of said cutting bed, said second module having a peripheral outline corresponding to a desired cut out area in said part, the supporting surface of each said module being spaced from the supporting surface of said second module to define a gap surrounding said second module to be followed by a said ganged cutting head in severing said cut outs from said parts.

10. Apparatus for cutting a plurality of individual parts of identical configuration as claimed in claim 1, including a catcher tank beneath said cutting bed, said cutting bed comprising a framework including spaced side arms mounted at one of their ends on a shaft, means journaling said shaft for rotation, a bed plate on said arms encompassing said modules and comprising said cutting bed, and means for selectively rotating said shaft to tilt said cutting bed for removing said selvedge portion.

11. Apparatus for cutting a plurality of individual parts of identical configuration as claimed in claim 1, including a carriage bar upon which said cutting heads are mounted in spaced relation therealong, a longitudinal slide rail upon which said carriage bar is mounted for movement to-and-fro therealong, a pair of spaced transverse slide rails, said longitudinal slide rail being carried by a beam mounted at its ends on said transverse slide rails for movement to-and-fro therealong, and means for moving said carriage bar along said longitudinal slide rail and said longitudinal slide rail along said transverse slide rails whereby said cutting heads follow said predetermined paths.

12. Apparatus for cutting a plurality of individual parts of identical configuration as claimed in claim 1, wherein said means lifting the severed individual parts comprises a shuttle transfer station including a carriage framework mounted for reciprocating movement between said cutting station and a run out conveyor adjacent thereto, means for reciprocally moving said carriage framework between said cutting station and said runout conveyor, and a vacuum cup for each said individual part on said carriage framework positioned and operable to selectively engage and lift each said individual part from said cutting bed and deposit said part on said runout conveyor.

13. Apparatus for cutting a plurality of individual parts of identical configuration as claimed in claim 12, wherein each said part includes an interior cutout portion and said carriage framework includes a vacuum cup for each said cut out portion adapted to engage and lift each said cut-out portion and deposit it on said run out conveyor, including a second conveyor spaced from said runout conveyor for receiving said parts from said runout conveyor and a receptacle between said runout and second conveyors whereby said cutout portions drop between said runout and second conveyors into said receptacle.

14. Apparatus for simultaneously cutting openings of identical configuration in each of a plurality of individual glass parts including a cutting bed for supporting said parts in predetermined positions, said cutting bed includes an individual support module for each said cutout portion, each said module being supported independently from the remainder of said cutting bed and having an outline corresponding to the outline of said cutout portion, a plurality of ganged abrasive fluid jet cutting heads mounted for controlled movement in unison over said cutting bed, means moving said ganged cutting heads along predetermined paths to simultaneously cutout said openings in said plurality of individual parts, and means lifting said individual parts and cutout portions from said openings and advancing them to a runout conveyor.

15. Apparatus for simultaneously cutting openings as claimed in claim 14, including a plurality of positioning guides on said cutting bed including means engaging the edges of said parts for aligning said parts in said predetermined positions.

16. Apparatus for simultaneously cutting openings as claimed in claim 15, including a layer of resilient material on said modules on which said parts rest, and a plurality of support bumpers at spaced locations on said cutting bed outside said modules, said bumpers having supporting tops coplanar with the surface of said layer of resilient material.

* * * * *